United States Patent [19]

Karls

[11] Patent Number: 4,540,009

[45] Date of Patent: Sep. 10, 1985

[54] FLUSHING DEVICE FOR OUTBOARD MOTORS

[75] Inventor: Michael A. Karls, Hilbert, Wis.

[73] Assignee: Brunswick Corporation, Skokie, Ill.

[21] Appl. No.: 624,325

[22] Filed: Jun. 25, 1984

[51] Int. Cl.[3] ..... B08B 9/00

[52] U.S. Cl. ..... 134/167 R; 134/199; 440/113

[58] Field of Search ..... 134/115 R, 165, 166 R, 134/167 R, 168 R, 169 R, 169 A, 177, 198, 199, 200; 285/DIG. 3, 260; 440/113, 900; 248/231.1

[56] References Cited

U.S. PATENT DOCUMENTS 3,931,828 1/1976 Lawler ..... 134/167 R 4,052,953 10/1977 Patel ..... 134/167 R 4,121,948 10/1978 Guhlin ..... 134/169 A X 4,196,883 4/1980 Einhorn et al. ..... 248/231.1 X 4,359,063 11/1982 Carlson ..... 134/167 R

*Primary Examiner*—Philip R. Coe

*Attorney, Agent, or Firm*—O. T. Sessions

[57] ABSTRACT

A flushing device (15) for supplying water to the cooling water inlets (14) of an outboard motor (10) uses a connecting pin (18) extending through the inlets (14) to attach a pair of sealing cups (16 and 17) over the inlets (14). A sliding spring latch (19) releasably attaches one of the cups (17) to the connecting pin (18). A hose connection (25) allows water to be supplied to the inlets (14) through the cup (16).

7 Claims, 4 Drawing Figures

FLUSHING DEVICE FOR OUTBOARD MOTORS

TECHNICAL FIELD

This invention relates to flushing devices for marine propulsion units and particularly to a device capable of being attached to an outboard propulsion unit when the unit is out of the water and supplying water to the water inlets.

BACKGROUND ART

Flushing devices are used to supply water to the water intake ports of outboard motors and stern drives to clean the internal passages of the motors or to provide coolant to allow the motors to be run while they are out of the water. Exemplary of such devices are the flushing accessory disclosed in U.S. Pat. No. 3,931,828 to Lawler issued on Jan. 13, 1976 and U.S. Pat. No. 4,052,953 to Patel issued on Oct. 11, 1977. The Lawler device uses a U-shaped body straddling the outboard propulsion unit to hold resilient sealing cups over the water inlets, while the Patel device uses a strap girdling the propulsion unit to hold a sealing cup over the water inlet. With these devices, considerable effort must be taken to assure that the sealing cups are accurately positioned over the water inlets to avoid water leakage and prevent air from being drawn into the cooling system.

DISCLOSURE OF INVENTION

One of the objects of this invention is to provide a flushing device for outboard propulsion units which easily and accurately locates sealing elements over the water inlets of the propulsion unit. Another object of the invention is to provide a flushing device which can be quickly and easily attached over the water intake ports on opposite sides of the outboard propulsion unit.

The present invention provides a flushing device for supplying water to the cooling water inlets located on opposite sides of an outboard propulsion unit. The flushing unit has a pair of resilient sealing elements for covering the cooling water inlets, with at least one of the sealing elements including a water passage for supplying water to one of the water inlets, a connecting means extending through the water inlets, and an attachment means for attaching the sealing elements to the connecting means and holding the sealing elements in position covering the inlets.

The connecting means can include a rod and the sealing elements can include holes therethrough with the rod extending through the holes. The attachment means in the preferred embodiment includes a head fixed on one end of the rod. The attachment means can further include a sliding latch, with the sealing elements positioned on the rod between the sliding latch and the head.

BEST MODE FOR CARRYING OUT THE INVENTION

Figure 1:
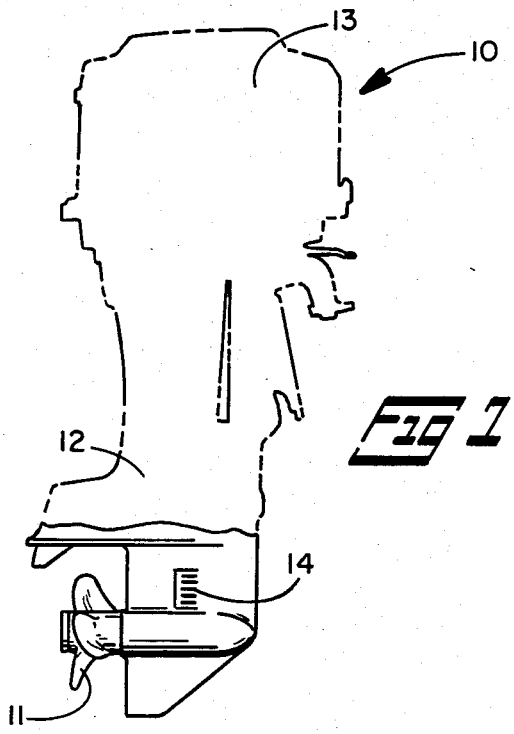
FIG. 1 is a side elevational view of a typical outboard motor.

Turning now to FIG. 1 a typical outboard motor 10 is shown. A propeller 11 is mounted on the lower end of the drive shaft housing 12 to be driven by an engine 13 mounted in the upper portion of the outboard motor 10. The engine 13 is cooled by water taken in through water inlets 14 provided on opposite sides of the lower portion of the outboard motor 10. The water inlets 14, as is normally the case, are located directly opposite each other and either there is no obstruction between the inlets 14 or a hole is drilled through any intervening structure.

Figure 2:
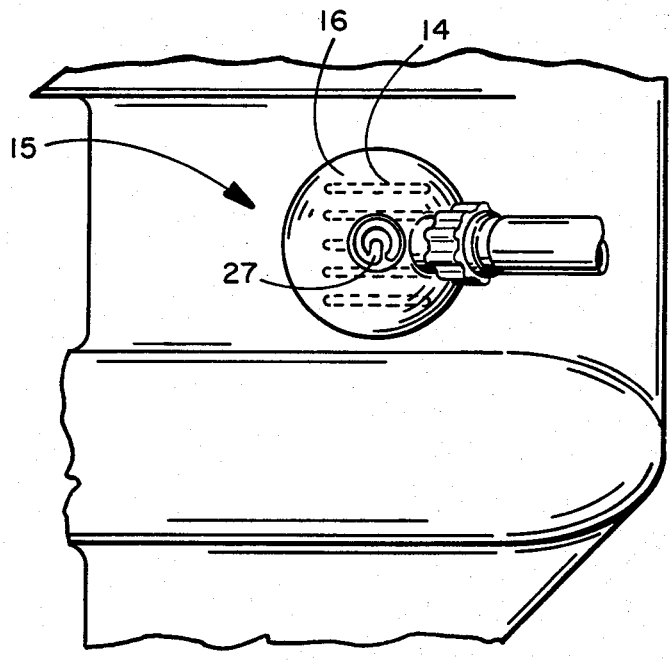
FIG. 2 is an enlarged partial view of the outboard motor of FIG. 1 showing a flushing device in place.
Figure 3:
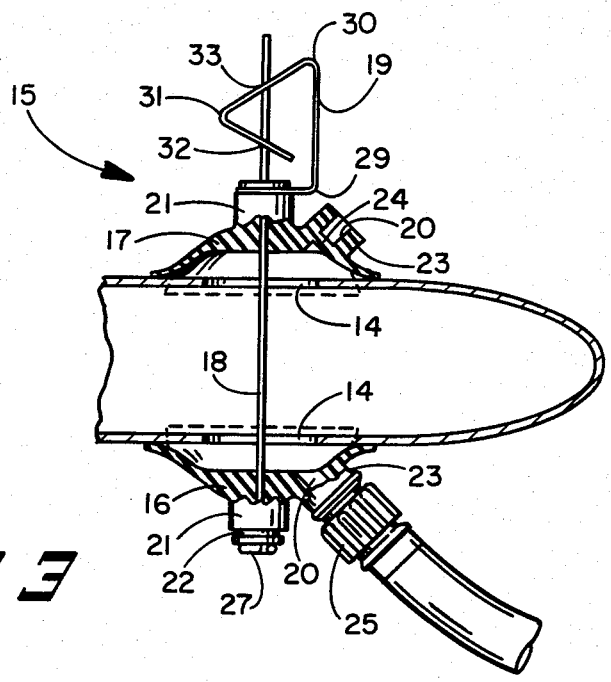
FIG. 3 is a partial sectional view of the device of FIG. 2.
Figure 4:
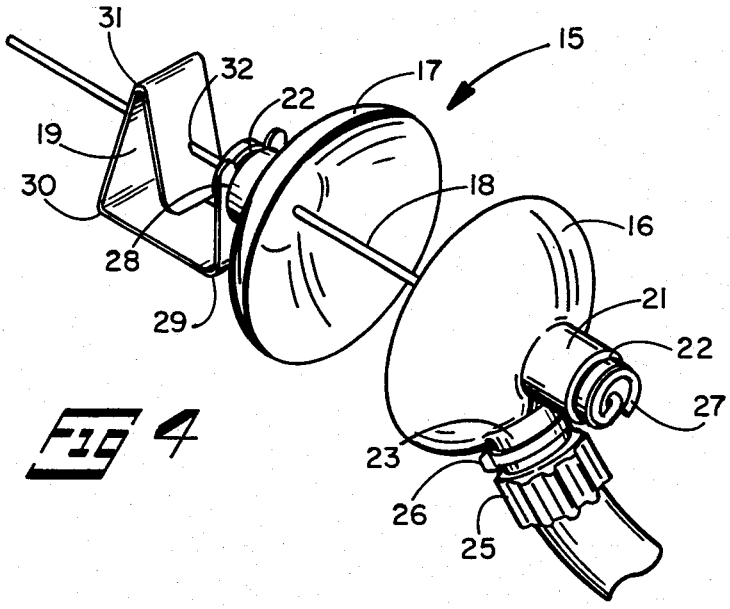
FIG. 4 is a perspective view of the flushing device.

FIGS. 2, 3, and 4 show a flushing device 15 according to the invention installed over the water inlets 14 of the outboard motor 10. The flushing device 15 includes a pair of sealing elements 16 and 17 covering each of the water inlets 14, a connecting rod or pin 18 extending through the two sealing elements 16 and 17 and the outboard motor's water inlets 14, and a sliding latch 19 fitting over the connecting rod 18 to hold the sealing elements 16 and 17 in position covering the inlets 14. At least one of the sealing elements 16 and 17 includes a water passage 20 for supplying cooling water to the water inlets 14.

The sealing elements 16 and 17 preferably are formed as identical cups. The cups are molded of a strong resilient synthetic elastomer and are relatively thick at the center and tapered toward the rims. This allows the cups to assume the shape shown in FIG. 3 when they are compressed against the outboard motor 10. Their unstressed shape is indicated by the dotted lines in FIG. 3. A central cylindrical body 21 is formed on the outside of the cup and includes an annular groove 22 at its outer end. A cylindrical boss 23, formed on the outside of the cup, is offset from the central cylindrical body 21. A water passage 20 is partially formed through the cylindrical boss 23. Removal of the plug 24 in the water passage 20 allows a hose connection 25 to be attached to the cup.

The hose connection 25 attached to the sealing cup 16 is a standard female water hose connector. The connector 25 includes a tubular portion inserted through the boss 23 on the cup and is held in place by a hose clamp 26.

The connecting rod or pin 18 is formed of spring tempered stainless steel. The rod 18 is inserted through holes formed through the central cylindrical portion of the cups 16 and 17. The holes have a slightly smaller diameter than the rod 18 to prevent leakage. A head 27, formed by a loop at one end of the rod 18, prevents the rod 18 from pulling through the cup.

The sliding spring latch 19 is attached to one of the cups 17 for removably latching the cup 17 to the connecting rod 18. The sliding spring latch 19 is formed of a strip of thin, spring tempered, stainless steel. An attachment hole 28 is formed at one end of the strip to allow attachment to the central cylindrical body 21 of one of the cups 17 at the annular groove 22. The strip is formed into a latch member by a 90° bend 29 adjacent the hole 28 and two 60° bends 30 and 31 which cause the strip to cross the axis of the connecting rod 18 two more times. Two holes 32 and 33, slightly larger than the diameter of the connecting rod 18, are formed in the two legs of the triangle formed by the strip which cross the axis of the connecting rod 18. The holes 32 and 33 are formed perpendicular to the strip so the inclination of the strip to the axis of the connecting rod 18 causes the two legs to act as a spring means and bind the edges of the holes 32 and 33 on the connecting rod 18 when the rod 18 is inserted through both of the holes 32 and 33.

To use the flushing device of the invention, the sealing cup 16 with the connecting rod 18 attached is placed over one of the water inlets 14 of the outboard motor 10. The connecting rod 18 thus extends through the water inlets 14 and out the opposite side. The other sealing cup 17 with the sliding latch 19 attached is then placed over the sealing rod 18 so the cup 17 covers the other water inlet 14. The connecting rod 18 is inserted through the two small holes 32 and 33 in the sliding latch 19 and the two cups 16 and 17 are then squeezed together to deform the cups as shown in FIG. 3. The resilience of the cups provides enough force to lock the sliding latch 19 and to seal the cups 16 and 17 over the water inlets 14. A hose may then be attached to the hose connection 25 and water supplied to the inlets to supply the engine 13 with water.

Removal of the flushing device 15 is accomplished by squeezing the two legs of the sliding spring latch 19 together to unbind the connecting rod 18 from the holes 32 and 33 in the latch. The sealing cups 16 and 17 can then be readily removed from the water inlets 14.

I claim:

1. A flushing device for supplying water to cooling water inlets located on opposite sides of an outboard propulsion unit, said device comprising:

(A) a pair of sealing elements for covering the cooling water inlets, at least one of said sealing elements including a water passage for supplying water to one of said water inlets;

(B) a connecting means extending through said water inlets; and (C) an attachment means for attaching said sealing elements to said connecting means and holding said sealing elements in position covering said inlets.

2. The flushing device defined in claim 1 wherein said connecting means includes a rod.

3. The flushing device defined in claim 2 wherein said sealing elements include holes therethrough, said rod extending through said holes.

4. The flushing device defined in claim 3 wherein said attachment means includes a head fixed on one end of said rod.

5. The flushing device defined in claim 4 wherein said attachment means further includes a sliding latch, with said sealing elements positioned on said rod between said sliding latch and said head.

6. The flushing device defined in claim 5 wherein said sliding latch is attached to one of said sealing elements.

7. The flushing device defined in claim 6 wherein said sliding latch has an arm having a latching hole therethrough, with said rod passing through said latching hole, and a spring means for binding said latching hole against said rod.

* * * * *